United States Patent [19]

Eash

[11] 4,058,155

[45] Nov. 15, 1977

[54] PORTABLE CENTRIFUGAL CASTING MACHINE

[75] Inventor: George Eash, Encino, Calif.

[73] Assignee: Crown Manufacturing Company, San Marcos, Calif.

[21] Appl. No.: 523,025

[22] Filed: Nov. 12, 1974

[51] Int. Cl.[2] ..... B22D 13/06

[52] U.S. Cl. ..... 164/152; 164/289

[58] Field of Search ..... 164/289, 290, 152, 287

[56] References Cited

U.S. PATENT DOCUMENTS

| | | | |
|---|---|---|---|
| 1,949,021 | 2/1934 | Leuser | 164/289 X |
| 2,009,489 | 7/1935 | Fritzsche | 164/287 X |
| 2,378,042 | 6/1945 | Sorensen et al. | 164/290 |
| Re. 17,783 | 8/1930 | Gardner et al. | 164/289 |

FOREIGN PATENT DOCUMENTS

| | | | |
|---|---|---|---|
| 444,683 | 1/1949 | Italy | 164/289 |
| 1,015,689 | 1/1966 | United Kingdom | 164/289 |

*Primary Examiner*—Robert D. Baldwin
*Attorney, Agent, or Firm*—George J. Netter

[57] ABSTRACT

A spring action portable centrifugal casting machine having a castor arm freely pivotable at a centrally balanced point has a horizontal pivotable extension arm attached thereto, and a crucible and flask entirely enclosed within a portable shield mounted on said extension arm.

5 Claims, 5 Drawing Figures

PORTABLE CENTRIFUGAL CASTING MACHINE

BACKGROUND OF THE INVENTION

There have been a number of centrifugal casting devices. Such devices employ centrifugal force to cause molten metal to be forced into small crevices in a mold. The present invention is directed towards a portable centrifugal casting machine which may be used for the casting of small metallic objects.

The basic operation of a centrifugal casting machine is well known, such as disclosed in U.S. Pat. No. Re. 17,783, issued to Gardner, et al, on Aug. 26, 1930. A casting arm is pivotably mounted at a centrally balanced point, ordinarily achieved by having a balance weight placed at one end of the casting arm. An extension arm is pivotably mounted to the casting arm so that it can rotate in a horizontal plane only. The extension arm supports the crucible and flask which contains the mold of the item to be cast. The crucible has an aperture in one end which aligns with the aperture of the mold entrance. Metal is deposited in the crucible and then melted by a heat source such as a blow torch. The extension arm supporting the crucible and flask assembly is placed in a position tangential to the direction of rotation of the casting arm to assist the centrifugal force in driving the molten metal into the mold. The casting arm is then rotated forcing the molten metal into the mold. The extension arm continues to automatically adjust so as always to maintain the molten metal under a centrifugal force. The molten metal is forced into the mold where it cools forming the casting. The prior art devices, however, did not provide an effective shield which could be easily attached to a portable centrifugal castor, in order to completely prevent the possible spillage of the molten metal during the casting operation. It was also essential that the shield not interfere in any manner with the actual ability to operate the casting device. In Gardner, U.S. Pat. No. Re. 17,783, a vertical shield 35 was provided as part of the stop. This shield, however, would not be effective to completely prevent possible spillage of the molten metal during casting.

The prior art devices also did not have a simple and inexpensive means for rotating the casting arm. The centrifugal casting device had internal springs or were motor driven. This is an undesirable feature which reduces the portable nature of the device and its ease of operation. In the present invention, an improved portable centrifugal casting machine is provided which has a shield which prevents the possible spillage of the molten metal during operation and which may be readily operated with safety and accuracy.

OBJECTS

An object of the present invention is to provide an improved portable centrifugal casting machine which has a shield which prevents any possible spillage of the molten metal during the casting operation.

A further object of the present invention is to provide an improved centrifugal casting machine which has a shield which does not interfere in any manner with the casting operation itself.

A further object of the present invention is to provide an improved centrifugal casting machine which has a shield which may be readily removed and replaced.

A further object of the present invention is to provide a centrifugal casting machine which has a simplified means for effectively imparting rotational movement to the casting arm.

These and additional objects of the present invention will become apparent from the following description and the accompanying drawings attached hereto.

Figure 1:
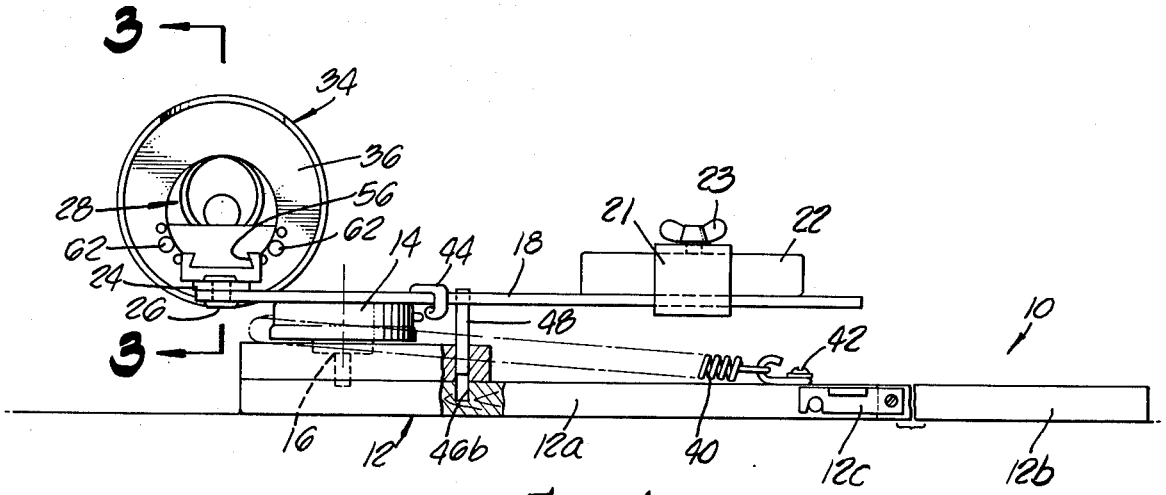
FIG. 1 is a side view of the portable centrifugal casting machine.
Figure 2:
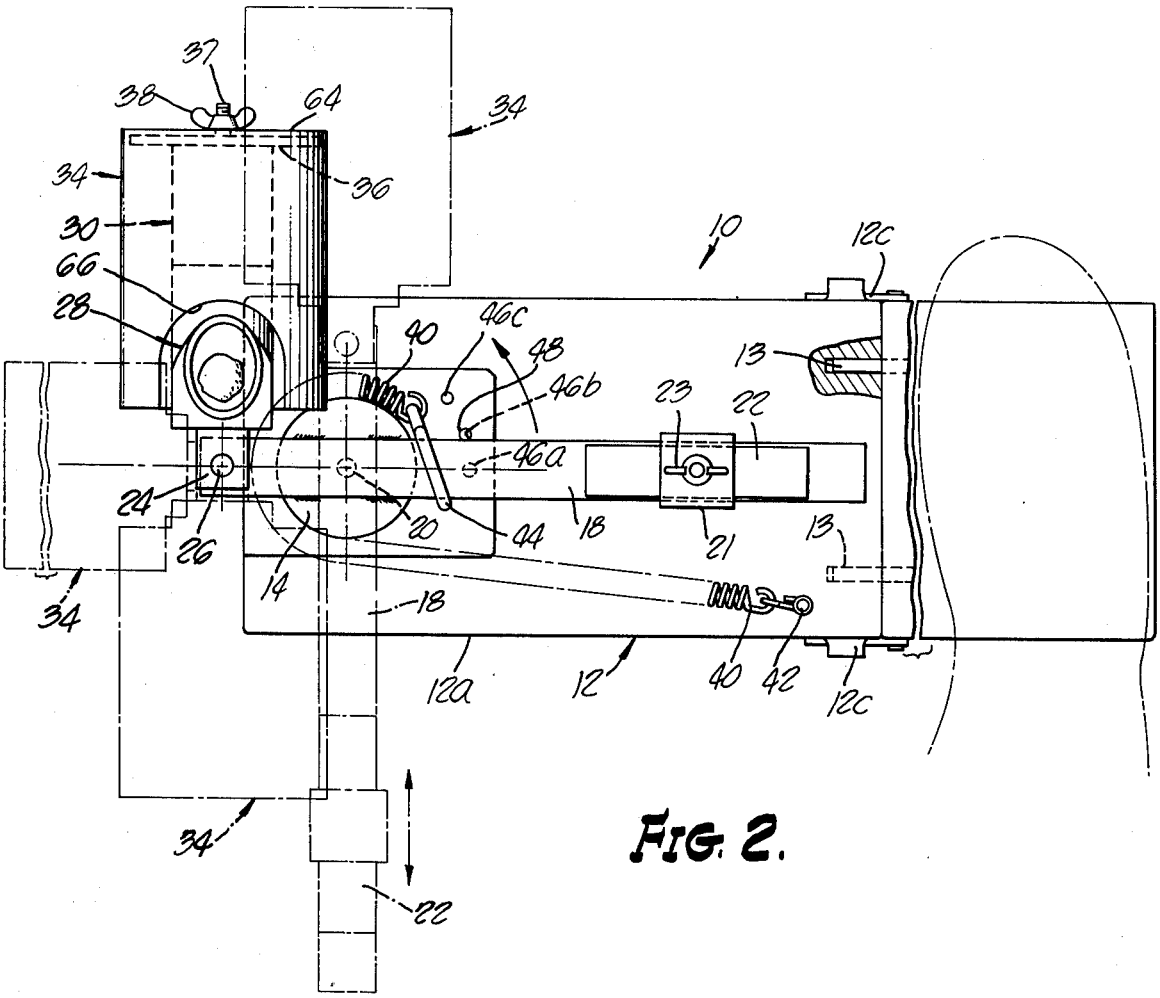
FIG. 2 is a plan view of the portable centrifugal casting machine of FIG. 1 with the casting arm and extension arm in a tensioned condition.

Referring to FIGS. 1 and 2 the portable centrifugal casting machine has a base 12 which is formed in two sections **12*a* and 12*b* held together during use by pins 13 and latch 12*c*. The two sections 12*a* and 12*b* may be folded for compactness when the machine is not in use. A casting arm 18 is mounted on a bearing 14 having ball bearings therein 16 at a centrally located point 20 of the casting arm. The casting arm 18 is freely rotatable about point 20** in a horizontal plane.

Figure 3:
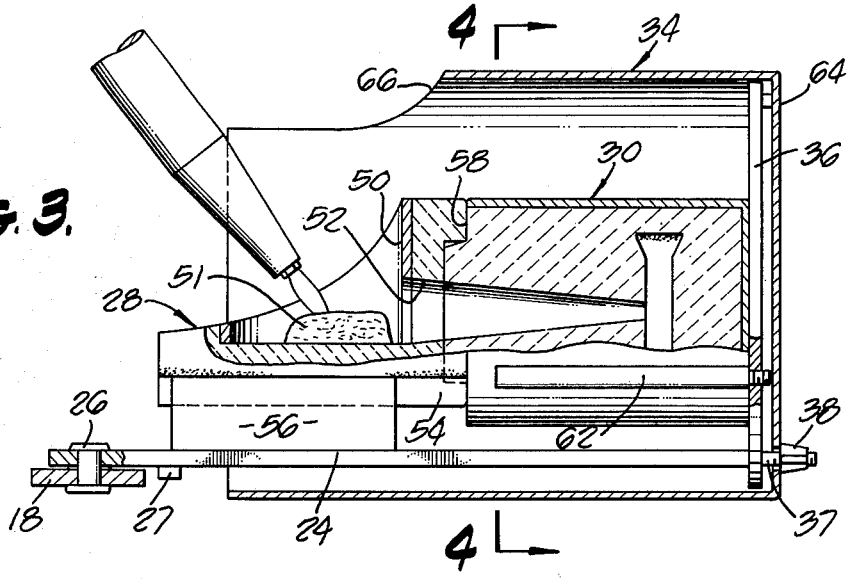
FIG. 3 is a cross-sectional view taken along line 3—3 of FIG. 1.
Figure 4:
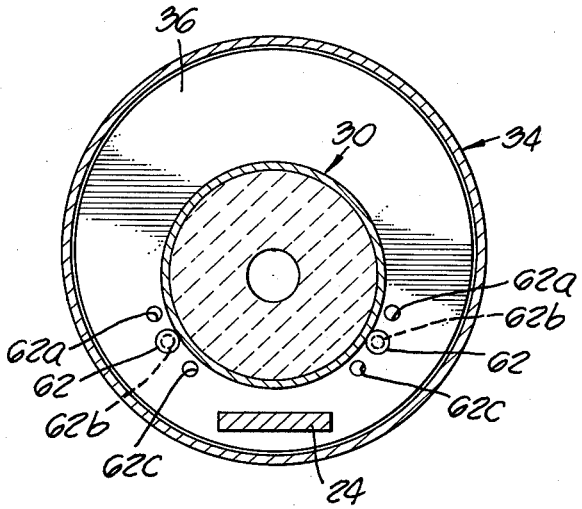
FIG. 4 is a cross-sectional end view taken along lines 4—4 of FIG. 3.

At one end of the casting arm 18 is located a balance weight 22. The balance weight 22 is pinned to casting arm 18 by belt 21 and thumb screw 23. The weight 22 is therefore slideably movable along the casting arm. At the other end of the casting arm is pivotably mounted extension arm 24 about pivot point 26. The extension arm 24 may rotate in a horizontal plane only, until restraining pin 27, shown in FIG. 3, abutts casting arm 18. A spring 40 fixed at one end 42 to restraining pin 44 is, as shown in FIG. 2, wrapped around the outer circumference of bearing 14. The other end of the spring 40 has a "U" shaped hook 44 which engages the casting arm 18. The mounting base **12*a* has a plurality of holes 46*a–c* therein, positioned in a circumferential pattern. A restraining pin 48 is inserted within one of the holes 46*a*, *b* or *c*, thereby restraining the casting arm 18 from moving under the tension of the springs 40, as shown in FIG. 1. The length of the restraining pin 48 is less than the vertical distance from the bottom of the hole 46 to the casting arm 18**.

Figure 5:
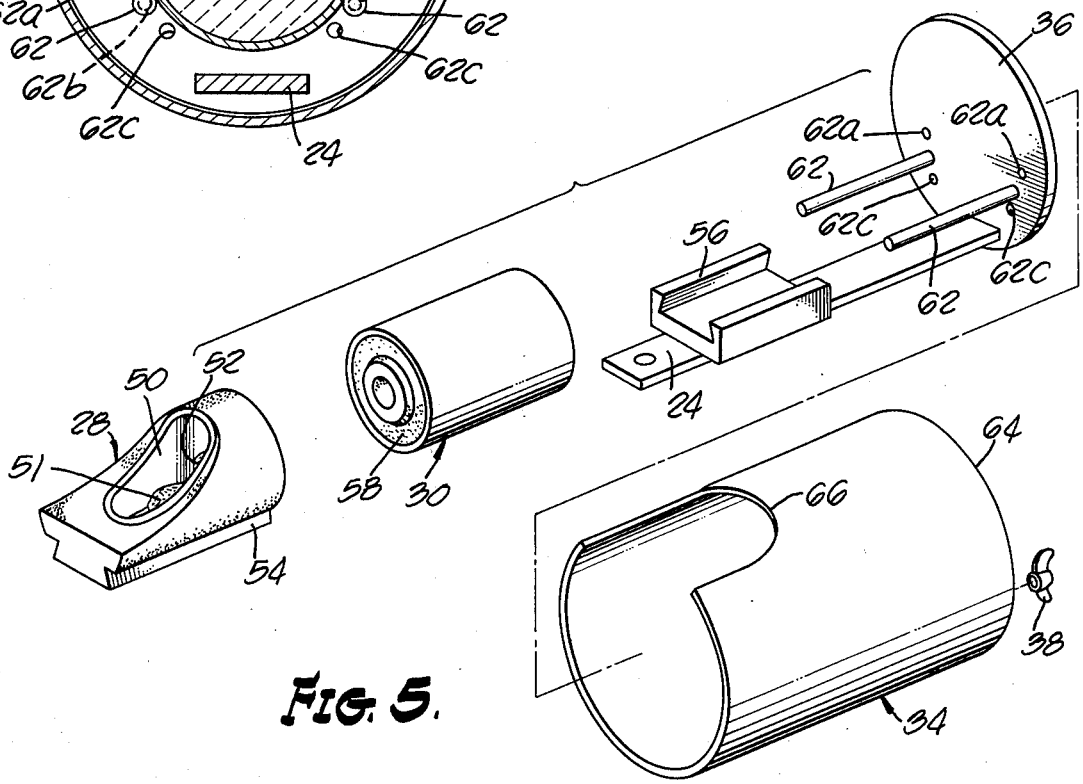
FIG. 5 is an exploded perspective view of the crucible, flask, flask support and shield mounted at the end of the extension arm.

Referring to FIG. 5 a crucible 28 having a dovetail bottom portion 54 slideably engages a complementary dovetail support 56 mounted on extension arm 24. The crucible 28 is a suitable heat resistant material which has a recess 50 in which metal 51 is heated and an aperture 52 through which the molten metal is forced during operation of the centrifugal casting machine.

Flask 30 is mounted on a flask support, pins 62 attached to the back plate 36. The pins 62 are threaded at one end and may be removed and replaced in approximately threaded aperatures **62*a* or 62*b* to support a larger or smaller flask 30. The mold 58 having an aperture in alignment with aperature 52 of the crucible is maintained within the flask. Projecting from the back portion of the back plate 36 is a screw 37, illustrated in FIG. 3. The screw 36 is offset from the center of the back plate 36 so as to be in line with extension arm 24. A shield 34 in the form of a hollow cylinder closed at one end 64, is of a sufficient length so as to completely enclose the sides and one end of the flask 30 and crucible 28 mounted on the extension arm 24. A cut out portion 66 is located along the edge of the open end of the shield 34. This permits a flame from a blow torch or other heat source to be able to heat any metal 51 which is placed in the recess 50 of the crucible 28. The closed end 64 of the shield 34 has a small hole which permits the screw 37 fixed to the back plate 36 to pass. A wing nut 38 engages the screw 37 and retains the shield 34** in place.

In operation, the casting arm 18 and extension arm 24 are aligned. The crucible 28, flask 30 and shield 24 are mounted on the extension arm 24 and the weight 22 moved to a position so that the casting arm 18 and extension arm 24 are balanced. The shield 34 and flask 30 are removed and the flask 30 heated to prevent premature cooling of the molten metal during operation. After heating, the flask 30 is placed on the support pins 62, the crucible 28 engaged within the slide 56 abutting the flask 30, and the shield 34 mounted in place over the flask 30 and crucible 28.

The "U" shaped member 44 is then engaged to casting arm 18 and the casting arm 18 is rotated to a position as shown in FIG. 2. Restraining pin 48 is then inserted in one of the appropriate holes 46. The pressure from the casting arm 18 holds the pin 48 in place. If more or less spring tension is desired, holes **46*a* or 46*c* may be used. The extension arm 24 is then rotated until stop 27 on the extension arm 24 abutts the casting arm 18**.

The metal 51 is then inserted within the recess 50 of the crucible 28 and heated with a blow torch until melted. The cut out portion 66 of the shield 34 allows the metal 51 to be heated by the flame without interference or hinderance.

One foot of the user is now placed on the base **12*b*, as shown in outline form in FIG. 2, and the casting arm 18 is rotated slightly until pin 48 drops into its hole 46. The casting arm 18 is then released and the spring 40 rotates the casting arm 18 about pivot point 20** at a rapid rate.

Centrifugal force forces the molten metal 51 out of the crucible 28 and into the mold 58. The flask 30 and crucible 28, supported on the extension arm 24, continues to rotate freely, adjusting to the reduced velocity of rotation of the casting arm 18. The shield 34 may then be taken and the flask containing the molded item removed.

The shield 34 prevents any of the molten metal 51 from being discharged during the casting operation.

The shield 34 should be of such a length as to extend over the crucible 28. The entire crucible 28 need not be covered but at least the portion of the crucible 28 in which molten metal is contained should be covered. Should an electric heater be used for melting the metal 51 the slot or cut away portion 66 may be eliminated.

While in the preferred embodiment the shield 34 is a one piece hollow cylinder having a closed end 64, in an alternate embodiment the shield 34 may consist of more than one piece such as shown in FIG. 5. The shield 34 may consist of a bottom segment **34*a* and a top segment 34*b*. The bottom segment 34*a* would be fixedly attached to the back plate 36 or the extension arm 24. The top segment 34*b* could be attached to the bottom segment 34*a* by a hinge arrangement (not shown) either on the side of the shield or along the rear closed end 64 of the shield. In such a way, the top segment 34*b* of the shield would be either entirely removed or rotated so as to permit the flask 30 and the crucible 28** to be placed in position.

It is also recognized that the shield may be in shapes other than cylindrical. For example, the shield 34 may have an oval shape so as to reduce air resistance during the rotation of the shield. Other streamlining of the shield is also contemplated. It is also contemplated that various types of mounting of the shield 34 may be employed with this invention. For example, the shield 34 may be placed on tracks so that the shield 34 may be retracted in a direction along the longitudinal axis of the extension arm 24. In each such embodiment, however, the shield 34 serves to prevent possible spillage of the molten metal 51 during the casting operation.

It should be noted that there is no necessity for having the open end of the shield 34 covered in any manner. Due to the centrifugal force imparted to the molten metal 51 the only direction of possible spillage of the molten metal is rearward. In each of the above embodiments, the shield 34 prevents spillage of the molten metal in all directions rearward of the recess 50 of the crucible 28.

I claim:

1. An improved centrifugal casting device for open air use, comprising:

a. a crucible having a recess therein;

b. a flask having a closed outer end and an open inner end, said flask containing a mold in communication with said crucible recess through said inner end;

c. mounting means supporting said crucible and flask for rotation about a vertical axis laterally spaced from said crucible and flask; and d. a shield having side walls and an end wall removably carried by said mounting means, said walls enclosing said crucible recess and said flask sides and outer end, and said mounting means including means supporting said end wall being outwardly of said crucible and flask during centrifugal operation.

2. The improved centrifugal casting device of claim 1 in which said shield comprises a hollow member with said side walls forming a first lower segment and a second upper segment, said hollow member being closed at at least one end by said end wall.

3. The improved centrifugal casting device of claim 2 in which the side walls of said hollow member define an open end opposite said end wall and a wall portion removed to form a cut out portion along its open end in the side wall forming said upper segment.

4. The improved centrifugal casting device of claim 2 in which said hollow member is removably mounted to said mounting means.

5. The improved centrifugal casting device of claim 3 in which said hollow member is cylindrical in shape.

* * * * *